US008616379B2

(12) United States Patent
Alderson et al.

(10) Patent No.: US 8,616,379 B2
(45) Date of Patent: Dec. 31, 2013

(54) REMOVABLE SUPPORT LEGS FOR USE WITH GOLD PROSPECTING SLUICE

(75) Inventors: Larry Allen Alderson, Robards, KY (US); Peggy I. Alderson, Robards, KY (US)

(73) Assignee: Larry A. Alderson, Robards, KY (US)

( * ) Notice: Subject to any disclaimer, the term of this patent is extended or adjusted under 35 U.S.C. 154(b) by 118 days.

(21) Appl. No.: 12/931,010

(22) Filed: Jan. 21, 2011

(65) Prior Publication Data

US 2011/0186486 A1 Aug. 4, 2011

Related U.S. Application Data

(60) Provisional application No. 61/337,318, filed on Feb. 1, 2010.

(51) Int. Cl.
*B03B 5/00* (2006.01)

(52) U.S. Cl.
USPC ..... 209/458; 209/44; 209/420; 209/472

(58) Field of Classification Search
USPC ..... 209/420, 458, 44, 127.1, 477
See application file for complete search history.

(56) References Cited

U.S. PATENT DOCUMENTS 2,493,955 A * 1/1950 Erickson ..... 104/126
3,805,710 A * 4/1974 Leshem ..... 108/6
4,319,985 A * 3/1982 Hibbard ..... 209/3
4,339,043 A * 7/1982 Tice et al. ..... 209/44
4,673,492 A * 6/1987 Jasinski ..... 209/477
6,155,318 A * 12/2000 Underwood ..... 144/286.1
6,799,681 B1 * 10/2004 Warren ..... 209/44
7,012,209 B2 * 3/2006 Loewen ..... 209/127.1

* cited by examiner

*Primary Examiner* — Terrell Matthews

(57) ABSTRACT

A portable device for use in the efficient extraction of gold from other materials commonly found in placer deposits of gravel, sand and etc. This is accomplished by utilizing two sub-assemblies easily attached to existing gold recovery equipment such as the common gold sluice and etc. This is accomplished by utilizing four sub-assemblies. Two on opposite sides and also two on opposite ends of the sluice tray. Each sub-assembly consists of a side bracket 14 and leg socket 18, which are conjoined by means of leg socket retaining fasteners 32. These are in turn are attached to cross brace 20 by means of side bracket positioning screws 28. Two sub-assemblies are attached to each other on opposite sides of the sluice tray and conjoined by means of shoulder bolt 22, washer 24 and retaining nut 26. After secure attachment of the two opposite sub-assemblies the legs are inserted into leg socket 18 and held in place by locking screw 16. These same actions are then performed on the opposite end of the gold sluice. When all sub-assemblies are in place the gold sluice is placed in position and final adjustments are made to each legs so that optimum gold sluice angle is achieved. Once initial installation has been made easy removal of the embodiments is accomplished by loosening retaining nut 26 allowing each sub-assembly to rotate and move away from each other thereby allowing removal of the entire embodiment. If desired by the prospector only the legs 12 may be removed and the rest of the embodiments left in place for easy transportation and storage.

1 Claim, 2 Drawing Sheets

REMOVABLE SUPPORT LEGS FOR USE WITH GOLD PROSPECTING SLUICE

REFERENCE TO RELATED APPLICATIONS

Figure 1:
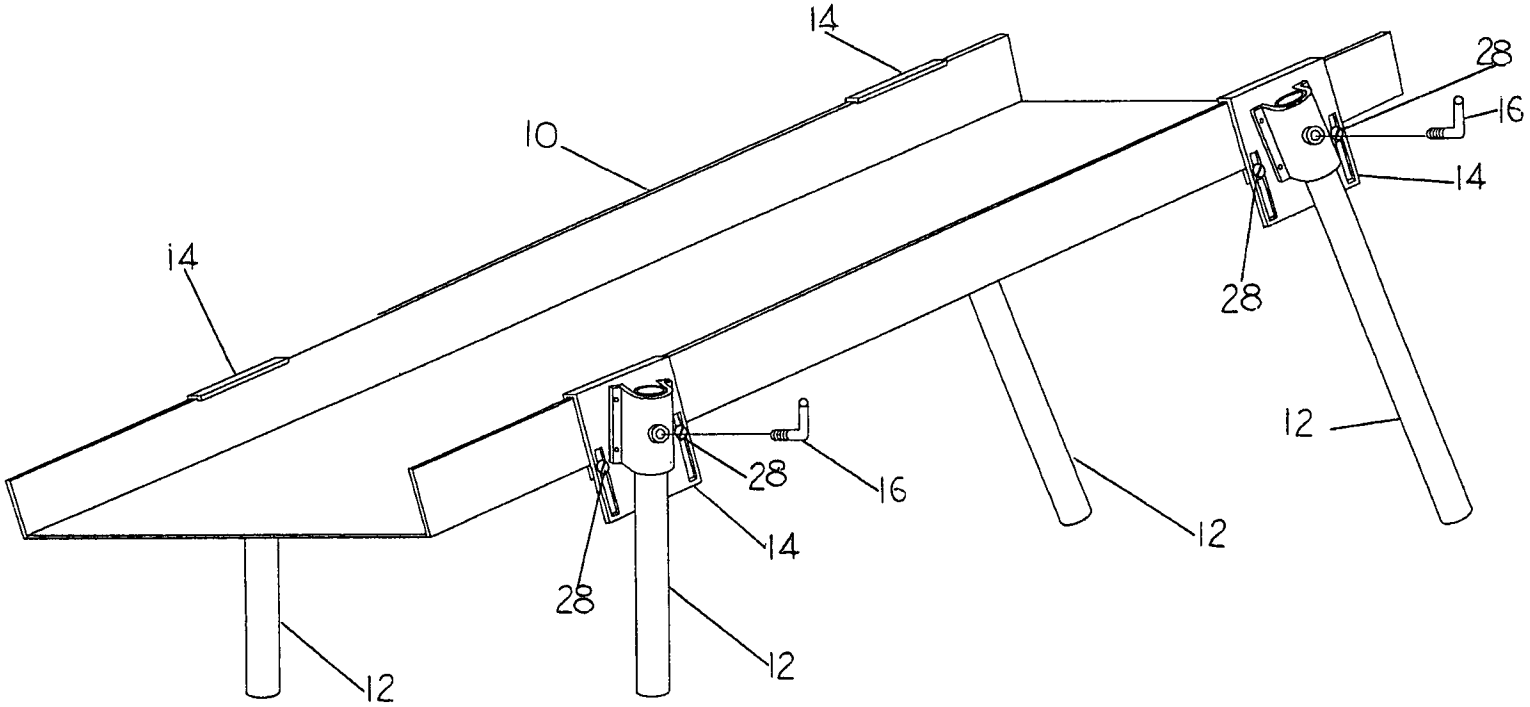

This application claims the benefit of provisional patent application No. 61/337,318 filed Feb. 1, 2010 by present inventors.

FEDERALLY SPONSORED RESEARCH

Not applicable

SEQUENCE LISTING OR PROGRAM

Not applicable

BACKGROUND

1. Field

This application relates to the mining of precious metals, such as gold

2. Prior Art

Recent patent search for prior art concerning the basic gold sluice has determined that its conception predates current patent processes. However, subsequent developments in its improvement are on record. Of note is the design of a typical sluice consisting of a bottom and two parallel vertical sides containing a series of perpendicular riffles. This basic design is shown in U.S. Pat. No. 185,116 issued December 1876 to Mann. Improvements to this design have have been made to increase its portability and efficiency. U.S. Pat. No. DES. 377,182 issued 7 Dec. 1997 to Simpson show such improvements as does U.S. Pat. No. 4,592,833 issued Jun. 3, 1986 to Perdue. While both these designs greatly improve on the basic design and internal efficiency of the sluice box no attempt has been made to improve upon its external features. Gold prospectors when using a standard gold sluice try and utilize whatever natural material is available for situating the sluice. This is a sometimes tedious and time consuming chore. In order to achieve maximum efficiency of the sluice, the proper angle in reference to the water flow must be achieved. This is nearly impossible with the locally available materials. No previous means of rectifying this problem have been designed.

Advantages

My invention addresses this shortcoming by providing an easily installed and removed support system capable of adjusting gold sluice slope thereby maximizing efficiency.

SUMMARY OF THE INVENTION

The purpose of the gold sluice is to separate the heavier gold bearing materials from typical placer sand and gravel deposits. This is accomplished by the use of flowing water through the sluice. By placing an amount of placer gravel and sand materials at the upper end of the sluice and utilizing this water flow over a series of riffles the heavier gold bearing materials are separated out of the slurry. This is accomplished by the heavier materials collecting in the low pressure or eddy areas behind the riffle devices. In order for optimum separation to take place it is necessary for the flow of water to be accurately controlled. Present practice by prospectors in the field has been to set the sluice into a flowing stream or river of water and try to adjust it by means of rocks, stones and whatever else is locally obtainable. As may be imagined this leaves a lot to be desired if accuracy is of concern. This problem is solved by use of the removable sluice support legs I have developed. Once installed they are easily adjusted to compensate for existing river bottom contours which vary greatly in very short distances Infinite adjustments are possible with very little time and effort.

DRAWING—FIGURES

Dwg. 1/2 FIG. 1 Shows the embodiment with the removable support legs installed with different components identified.

Figure 2:
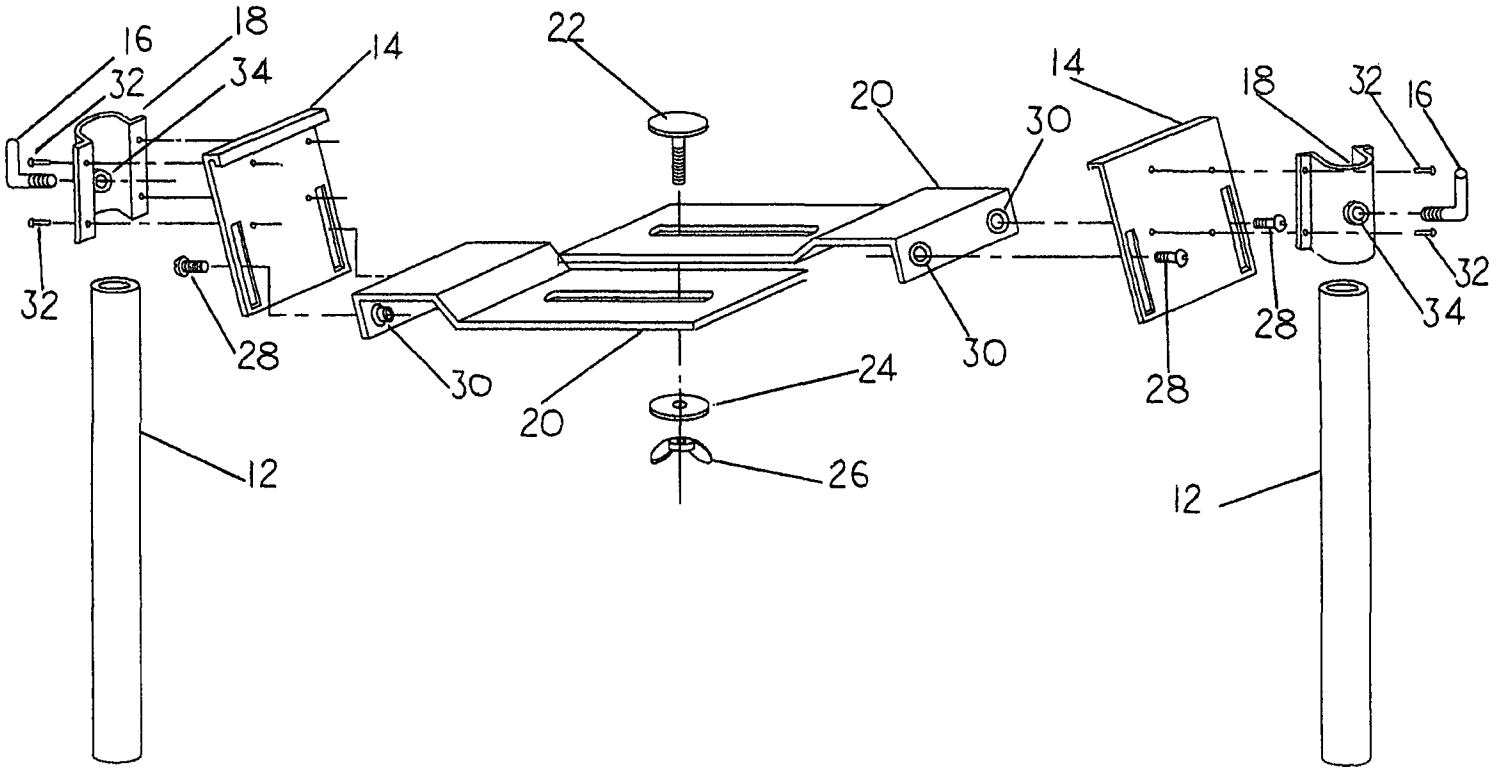

Dwg. 2/2 FIG. 2 Shows the embodiment in an exploded view with the different components identified.

DRAWINGS—REFERENCE NUMERALS

10 Gold sluice
12 Leg
14 Side bracket
16 Locking screw
18 Leg socket
20 Cross brace
22 Shoulder bolt
24 Washer
26 Retaining nut
28 Side bracket positioning screw
30 Side bracket positioning screw captive nut
32 Leg socket retaining fastener
34 Locking screw captive nut

DETAILED DESCRIPTION

FIG. 1 of the embodiments are shown on Dwg. 1/2 shows the embodiments in their installed configurations. There have been two sets of embodiments installed on opposite ends of a typical gold sluice 10. Side brackets 14 have been attached to the sides of the gold sluice 10 by means of a lip of the side bracket 14. Legs 12 are in position and locking screws 16 are ready to be installed thereby retaining legs 12 in proper position. Proper angle of the gold sluice 10 is achieved by loosening locking screw 16 and adjusting leg 12 either up or down. This adjustment is made at each of the four corners of the gold sluice 10. When all adjustments have been made, maximum gold recovery is accomplished.

DETAILED DESCRIPTION

FIG. 2

FIG. 2 of the embodiment is shown in an exploded or unassembled view. Legs 12 are shown ready to be inserted into leg sockets 18. Leg sockets 18 are ready to be attached to side brackets 14 by means of leg socket retaining fasteners 32. Locking screws 16 are ready to be installed into locking screw captive nuts which have been installed into leg sockets 18. Side brackets 14 are ready to be attached to cross braces 20 by means of side bracket positioning screws 28 installed through side brackets 14 and into side brackets positioning screw captive nuts 30 which have been installed into cross braces 20. Two of the embodiments are assembled on opposite sides of each end of the gold sluice. This is accomplished by inserting the shoulder bolt 22 through the slots in cross braces 20. Shoulder bolt 22 is retained in position by washer 24 and retaining nut 26.

Operation

The embodiment is loosely assembled as previously described in FIGS. 1 and 2 with the exception of leg sockets 18, locking screw captive nut 34 and side bracket positioning screw captive nuts 30. Since all gold sluices are not necessarily of the same size, provisions are provided in the embodiments to accommodate for size differences. This is accomplished by means of slots in cross braces 20 and side brackets 14. Side brackets 14 are attached to the vertical sides of the gold sluice by means of a small inward turned lip. This lip is hooked over uppermost edge of the vertical sluice side allowing it to hang while cross braces 20 are raised against to bottom of the gold sluice. When pressed tightly against the bottom of the gold sluice the side bracket positioning screws are tightened thereby holding the assembly in position. When both sides have been assembled they are joined together by means of tightening the retaining nut 26 which loosely installed on shoulder bolt 22. When these assembly operations have been completed the entire embodiment is firmly attached to the gold sluice and will look like FIG. 1 Dwg. 1. Final adjustments are made when the entire assembly, including the embodiments, are placed in the river or stream to be prospected. Final adjustments are made by positioning legs 12 against the stream bottom and tightening locking screws 16. This adjustment is made at each end and each side of the gold sluice. Final angle is adjusted to the prospectors satisfaction.

Once the original installation has been completed, the embodiments may be removed by loosening retaining nut 26. This allows the sub-assemblies consisting of 12,14,16,18,20 on each side of the sluice to be rotated outwardly away from the sub-assembly on the opposite side. This allows for the easy removal of the embodiments from the sluice for ease of transportation. Re-attachment is a reversal of the last steps. Re-positioning of side bracket 14 on cross brace 20 is no longer required after original installation on the gold sluice.

CONCLUSION, RAMIFICATION AND SCOPE

The reader will see that the embodiment of the present invention enables a gold prospector to easily set up and position his gold sluice for optimum gold recovery. The time saved by using this invention will greatly increase the time spent actually recovering gold. Since obvious changes may be made in the specific embodiment of the invention described herein, it is indicated that all matter contained herein is intended as illustrative and not limited in scope.

For example the embodiment shown herein is constructed utilizing lightweight metal, i.e. aluminum. Other methods of construction are also possibilities, such as plastic and etc. Some of the attachments may be molded or welded onto the embodiment in lieu of using fasteners. The proportions of different components may be changed and methods of attachment may be altered. Thus the scope of the invention should be determined by the appended claims and their legal equivalents, rather than just by the examples given.

What we claim and desire to secure by Letters of Patent of the United States is:

1. A new and novel portable prospecting device comprising:

a support system consisting of a plurality of identical support assemblies for easy attachment to opposite ends of a variety of sluice box designs; whereas said support system to include features allowing infinite adjustments bilaterally to compensate for varying terrain conditions as well as ability to adjust for optimum operating incline of said sluice box; whereas each said support system consists of two sub-assemblies; whereas each said subassembly, consisting of a vertical side bracket, cross brace, leg socket, leg, a plurality of vertical side bracket positioning screws, shoulder bolt, washer, wing nut and leg locking screw; whereas each said subassembly, is positioned and retained onto said sluice box by means of an inwardly formed lip located at uppermost edge of said vertical side bracket and hooked over upper most vertical edge of said sluice box side wall; whereas each said leg socket to be attached to exterior surface of said side bracket; and each said vertical side bracket to be held in position against outside vertical side wall of said sluice box by means of said cross brace which is attached to said vertical side bracket by insertion of a plurality of side bracket positioning screws through parallel elongated slots in said vertical side bracket and threaded into said side bracket positioning screw captive nuts located in downturned vertical short side of said cross brace and on same axis on said cross brace; whereas said parallel elongated slots located vertically in said vertical side bracket to allow for vertical adjustment, so as to adapt to said variety of sluice box side wall and bottom designs and dimensions; whereas two of said subassemblies mated with each other across external bottom planer surface of said sluice box, with first said sub-assembly positioned 180 degrees from second said sub-assembly on same axis and overlapping planes and co-joined by insertion of said shoulder bolt, downwardly and vertically through centrally positioned and commonly aligned elongated slots and retained by said washer and wingnut; whereas said support sub-assemblies, when adjusted vertically and horizontally inward and against said sluice box sides and bottom and are retained by tightening said side bracket positioning screws and said shoulder bolt, washer and wing nut; and inserting said legs into and through said leg sockets and positioned with said leg locking screws; whereas two said support systems when attached to opposing ends of said sluice box's gives the user said infinite bilateral adjustment thereof.

* * * * *